United States Patent [19]

Berg

[11] 4,406,744

[45] Sep. 27, 1983

[54] PROCESS FOR THE PRODUCTION OF HYDROGENATED TAR AND DISTILLATES AND LOW SULFUR COKE FROM COAL

[76] Inventor: Clyde Berg, 3655 E. Ocean Blvd., Suite 2-H, Long Beach, Calif. 90803

[21] Appl. No.: 321,901

[22] Filed: Nov. 16, 1981

[51] Int. Cl.[3] ..... C10B 49/06; C10B 57/02; C10B 57/12

[52] U.S. Cl. ..... 201/17; 201/29; 201/33; 201/34; 201/38; 201/44

[58] Field of Search ..... 201/17, 29, 33, 34, 201/36, 38, 39, 44, 45

[56] References Cited

U.S. PATENT DOCUMENTS

| | | | |
|---|---|---|---|
| 1,690,935 | 11/1928 | Hubmann | 201/34 |
| 3,284,915 | 11/1966 | Berg | 34/10 |
| 3,316,155 | 4/1967 | Holowaty et al. | 201/34 |
| 3,349,022 | 10/1967 | Mitchell et al. | 201/34 |
| 3,705,086 | 12/1972 | Schmalfeld et al. | 201/34 |
| 3,841,992 | 10/1974 | Jones et al. | 201/34 |
| 4,002,534 | 1/1977 | Rammler et al. | 201/34 |
| 4,203,960 | 5/1980 | Bauer et al. | 201/17 |

*Primary Examiner*—Bradley Garris
*Attorney, Agent, or Firm*—Fischer, Tachner & Strauss

[57] ABSTRACT

The production of hydrogenated tar and distillates from coal which is passed through successive condensing, hydrogenation, desulfurization and cooling zones of a dense bed while a flue gas is discharged into the lower portion of the desulfurization zone in admixture with steam and hydrogen for countercurrent flow contact with the coal and coke solids. The gases evolved from the desulfurization zone are passed into countercurrent contact with the coal in the preceding hydrogenation zone where the high boiling coal tar fractions evolved from the coal are hydrogenated and pyrolyzed. The total effluent from the hydrogenation zone is then passed into countercurrent contact with the coal in the condensing zone, preheating the coal by direct contact and initiating the pyrolysis of the coal. The preferred method is practiced in a vertical kiln through which the coal is passed as a dense, compact gravitating bed of solids. The kiln preferably has a centrally disposed gas burner with an oscillating internal baffle which prevents agglomeration of the coal solids.

7 Claims, 2 Drawing Figures

PROCESS FOR THE PRODUCTION OF HYDROGENATED TAR AND DISTILLATES AND LOW SULFUR COKE FROM COAL

BACKGROUND OF THE INVENTION

The pyrolysis of coal commonly produces a high density coal tar, more dense than water, which is difficult to process and refine to useful products. Hydrogenation of the coal tar has been attempted, however, currently there is no efficient process or apparatus for effecting hydrogenation of the coal tar into useful products.

Coal, which is plentifully available in this country contains a relatively high content of sulfur, typically up to about 5 weight percent and its pyrolysis produces coal tar and coke having objectionable quantities of sulfur impurities. The sulfur impurities in the coke product are extremely difficult to remove by conventional technology and the coke thus has a low value and limited utility.

During pyrolysis, coal also has a tendency to plasticize, becoming soft and agglomerating. This tendency makes the coal difficult to process and handle in most pyrolysis equipment and, accordingly, there is a need for equipment that can efficiently maintain coke in a friable state during its pyrolysis. In my prior patent, U.S. Pat. No. 3,284,915, I disclose an apparatus for calcining green pertroleum coke which has an internal oscillating solids baffle that prevents agglomeration of the coke. Although I suggested that this apparatus could also be used for coal calcination, there is no obvious application of this apparatus for the simultaneous desulfurization of coke and hydrogenation of the coal tar products.

BRIEF DESCRIPTION OF THE INVENTION

This invention comprises a process for the treatment of hydrocarbonaceous minerals such as oil shale and coal, preferably coal, for the production of a low density, hydrogenated tar and distillate products and for production of a low sulfur content coke from sulfur containing coals. The process of the invention comprises passing particulate coal solids downwardly as a compact dense bed in countercurrent flow contact with gas and vapor streams. The coal is passed downwardly through the following successive treatment zones:

(1) A condensing zone wherein the coal is heated from the inlet temperature to a temperature of about 900 degrees F. and high boiling coal tar fractions are refluxed to further treatment;

(2) A hydrogenation zone where the coal is further heated to a temperature of about 1200 degrees F. and the high boiling coal tar fractions are cracked and hydrogenated;

(3) A desulfurization zone wherein the coal and coke resulting from the preceeding zone are heated to a temperature of about 1800 degrees F. whereby the coke is desulfurized; and (4) A cooling zone where the desulfurized coke product of the process is cooled to a temperature below about 500 degrees F.

The heat for the process is obtained by combustion of a suitable fuel, preferably a fuel gas which is at least partially generated in the process. This heating can be effected by a centrally disposed fuel burner located within the compact dense gravitating bed of coal and coke solids.

The desulfurization of the coke is achieved by introducing a gaseous mixture of steam and hydrogen from the subjacent cooling zone into the lower portion of the desulfurization zone. Additional or supplemental quantities of steam and hydrogen can also be introduced, preferably into turbulent flow mixing with the hot flue gases generated by the fuel burner and the resultant mixture of hot flue gases, steam, and hydrogen are introduced into the lower portion of the desulfurization zone.

The coke is desulfurized by the reaction of steam and/or hydrogen with the sulfur compounds in the coke, typically iron sulfide. The steam reacts also with the carbon of the coke and coal solids, producing carbon monoxide and hydrogen, the later being available for hydrogenation of the coal tar and distillate fractions produced by the process. The products evolved from the pyrolysis are passed upwardly through the condensing zone in countercurrent flow contact with the cooler coal solids and the high boiling fractions evolved from the coal are condensed and refluxed to the hydrogenation zone.

The process is preferably carried out in an apparatus which includes at least one oscillating solids baffle spaced intermediate the length of the kiln vessel and operable to distribute the gas flow and to prevent agglomeration of the coal and coke solids.

DESCRIPTION OF THE DRAWINGS

The invention will be described with reference to the figures of which.

DESCRIPTION OF PREFERRED EMBODIMENTS

Figure 1:
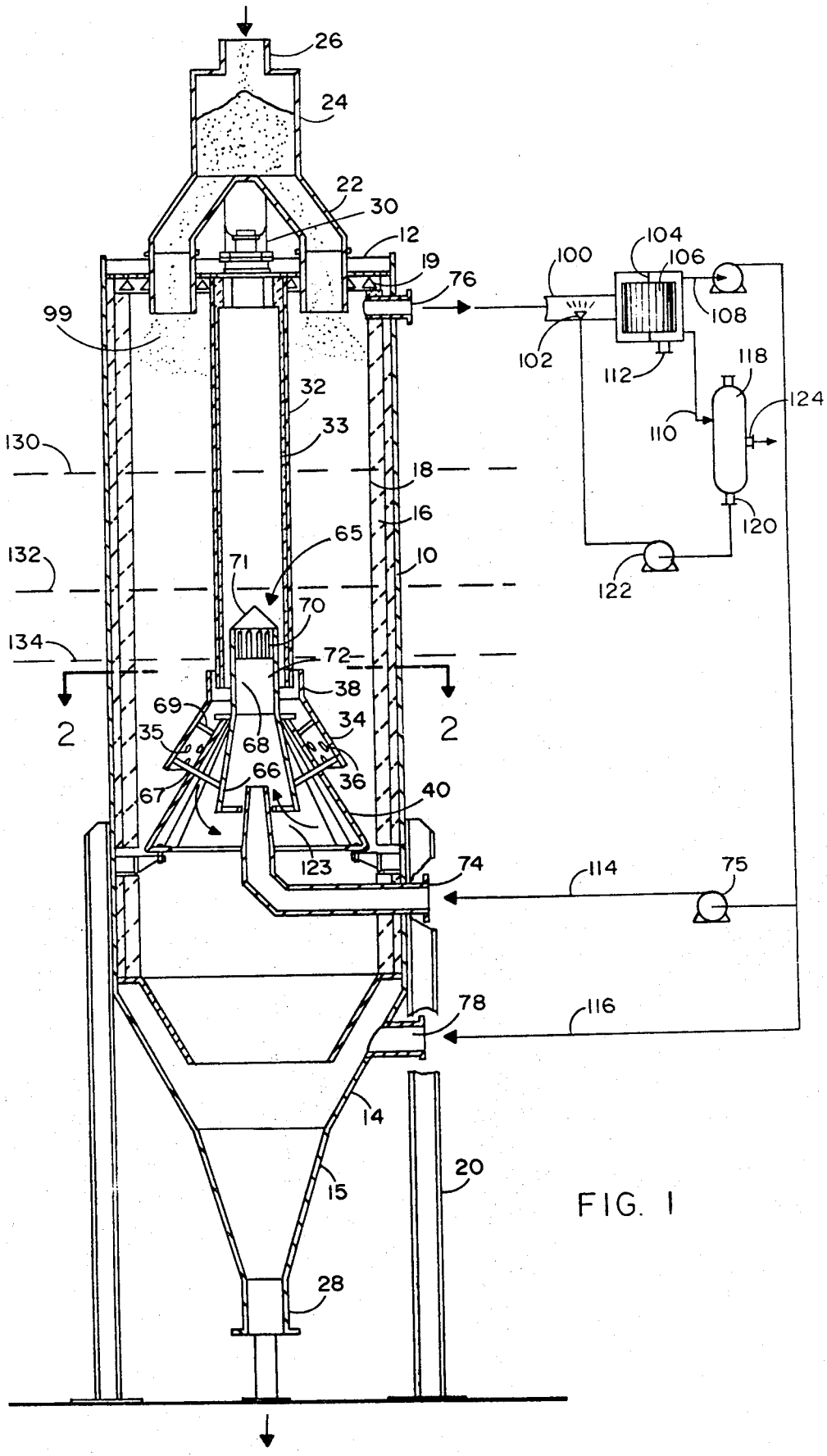
FIG. 1 is a vertical sectional view through the preferred vertical kiln used in the practice of my process.
Figure 2:
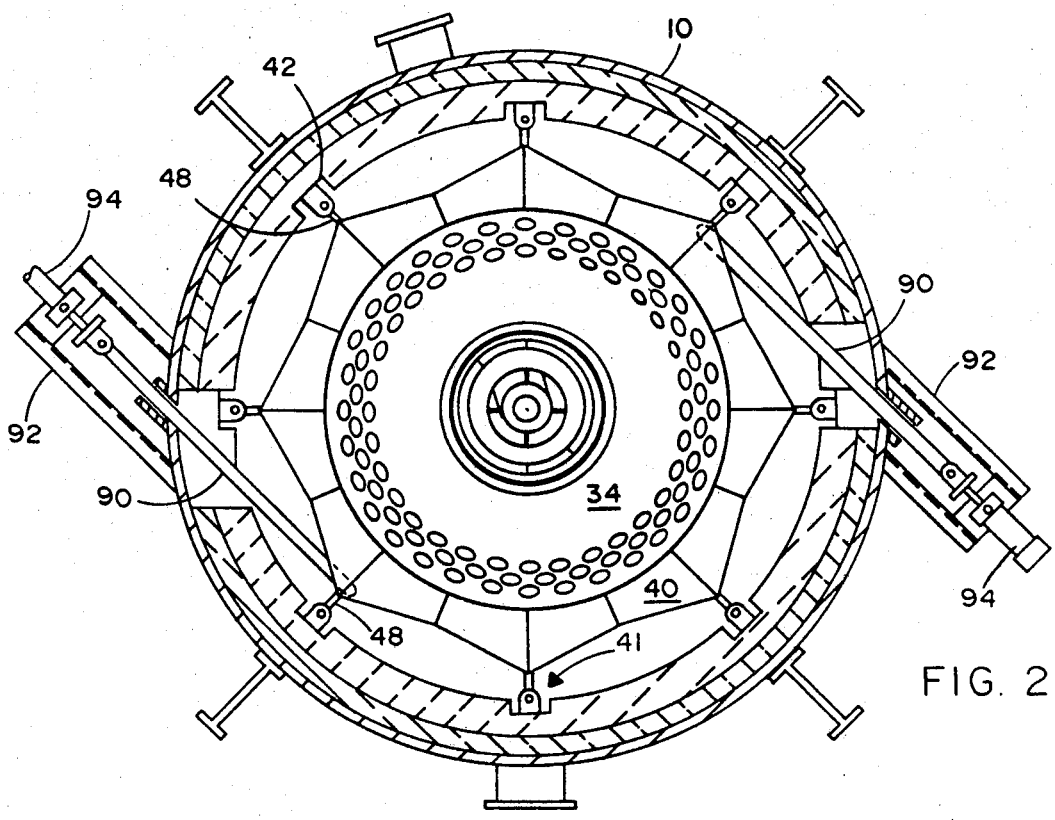
FIG. 2 is a horizontal sectional view along lines 2—2 of FIG. 1.

The process of this invention is preferably carried out in a vertical kiln substantially similar to that described in my prior patent, U.S. Pat. No. 3,284,915, however, the upper portion of this vessel is substantially lengthened to provide the condensing and hydrogenation zones used in the present invention. This apparatus is illustrated in FIGS. 1 and 2. As shown therein, the vertical kiln consists of a vertical shaft kiln defined by cylindrical shell 10, upper cover plate 12 and conical bottom 14. The shell 10 is preferably lined with successive, insulating layers of blocks 16 and fire brick 18 and the cover plate 12 is also insulated by castable refractory 19. The kiln is supported by a plurality of legs 20 which are attached to the shell 10 at spaced-apart intervals.

The conical bottom 14 of the kiln is preferably substantially elongated as illustrated by the transition section 15 between cone 14 and outlet nozzle 28 to permit processing of the coke solids without interruptions from clogging of the outlet nozzle 28.

At the upper end of the kiln, cover plate 12 is provided with four, equally spaced-apart apertures that receive four delivery conduits 22 that communicate with the superimposed coal feed hopper 24 which has an upper solids inlet nozzle 26. The coal solids in particulate form are delivered to feed hopper 24 through nozzle 26 utilizing a solids vane feeder (not illustrated) that is mounted on nozzle 26 to isolate the kiln from the environment and prevent emission of gas and vapors to the atmosphere. The solids level is maintained in the feed hopper by a conventional solids level controller and the solids flow through the kiln is controlled by a vibratory discharge feeder (not illustrated) attached to the discharge nozzle 28 of the kiln.

The kiln also includes a gas fired burner 30 which receives conventional combustible gas conduits (not illustrated) and which is mounted centrally in the cover plate 12. A vertical burner tube 32 is centrally placed within the kiln, extending from cover plate 12 to an intermediate location in the kiln. This tube 32 is internally lined with a castable refractory 33. A conical gas distributor 34 having a plurality of apertures 36 spaced about its lower portion is mounted at the discharge of the vertical burner tube 32. The apertures 36 provide approximately fifty percent open area in the surface of the gas distributor 34 to provide a large gas-solid interface area in the kiln. The conical gas distributor 34 is substantially smaller at its largest diameter than the internal diameter of the kiln and is attached to ring 38 which extends a short distance above the bottom end of burner tube 32. The ring 38 is spaced slightly apart from the outer surface of burner tube 32, permitting oscillary movement of the conical gas distributor 34 but not permitting any appreciable gas flow between ring 38 and tube 32.

An inverted conical solids baffle 40 is spaced from and slightly below the gas distributor 34, positioned with its upper portion received within the conical gas distributor 34, forming a conical annulus 35 therebetween. Preferably, conical solids baffle 40 has a corrugated surface providing structural stability and a surface to engage the surrounding coal and coke solids during operation of the oscillating mechanism. The resultant scalloped bottom periphery of baffle 40 provides a plurality of points in proximity to the inner wall of the kiln and, intermediate these points, open areas as required to permit solids flow into the lower portion of the kiln, below baffle 40.

The baffle 40 is pivotably supported at its bottom edge from the shell 10 by a plurality of pivot assemblies 41 (illustrated in FIG. 2). Each pivot assembly includes a bracket 42 supported from the inner wall of shell 10 to provide a pivotable support for its arm 48. The latter arms extend from each of the brackets 42 into a pivotable engagement with the bottom edge of conical baffle 40.

The gas distributor 34 is supported from the upper surface of conical solids baffle 40 by a plurality of cross braces 67 and 69. The assembly also includes an aspirator conduit 65 formed of a lower, tapered tube 66 and an upper cylindrical tube 68. The tube 68 has an upper outlet defined by vertical vanes 70 that are capped by a conical refractory cap 71. The upper cylindrical tube 68 is of smaller diameter than burner tube 32 and extends inwardly therein a substantial distance, forming an annular gas flow space therebetween. The vanes 70 in the upper end of conduit 68 are set at an angle of approximately 45 degrees to a tangent to the circumference of the tube 68 to provide a rotational direction to gas flowing through this tube.

The vertical aspirator nozzle 72 also receives, at its lower end, the discharge of a gas injection conduit 74 which enters the kiln through shell 10 at a location beneath the pivot assemblies 41. The resultant assembly forms an aspirating mechanism to draw gases from below the lower tapered tube 66 when a jet stream of fluid is injected into the kiln through the conduit 74 and the aspirator nozzle 72. This aspirating assembly results in a forced circulation of gases through the gas burner tube, rising upwardly in the aspirator nozzle 72 and discharging downwardly in admixture with flue gases through the annular space between the aspirator nozzle 72 and burner tube 32 for discharge through the apertures 35 of gas distributor 36.

The vapor product outlet conduit 76 is located at the top of the kiln in shell 10. In accordance with this invention, nozzle 76 is connected to conduit 100 which includes a water spray nozzle 102 and which discharges into a mist or liquid droplet removal device. Preferably a Rotocone 104 is used, which is a closed vessel in which is rotatably mounted a vaned cylindrical baffle 106. The vessel 104 is provided with a gas withdrawal conduit 108, a liquid withdrawal conduit 110 and a solids removal nozzle 112. The gas withdrawal conduit 108 discharges into a gas blower where the gas can be recompressed and returned to the treatment kiln through conduit 114 which discharges into the gas inlet nozzle 74 and conduit 116 which discharges into the lowermost gas inlet nozzle 78 supported in the conical bottom 14 of shell 10. Preferably, a second blower 75 is provided to boost the recycle gas pressure sufficiently to discharge the recycle gas through nozzle 74 into the intermediate location of the bed 99.

The liquid withdrawal conduit 110 discharges into an oil-water separator 118 from which water is withdrawn through the bottom nozzle 120 and returned by pump 122 to the spray nozzle 102. The oil fraction is removed through nozzle 124 as product from the process.

Referring now to FIG. 2, the construction of the oscillating mechanism of the vessel will be described. As illustrated in FIG. 2, shell 10 supports tangential nozzles 92, each of which receives a conventional hydraulic drive mechanism 94. The drive shaft 90 is connected to the driver of each hydraulic mechanism 94 at one end and is attached at the other end to a pivotable connection with pivot arm 48. A back and forth oscillatory motion with a stroke length controlled by adjustment of the hydraulic drive mechanism 94 can thus be transmitted to the internal conical baffles 34 and 40 and to the solids flowing past these conical baffles.

The apparatus as thus described is used in the process of this invention. The process comprises the carbonization and hydrogenation of coal to produce a hydrogenated low temperature tar, distillate products and a desulfurized coke product. In this process, the coke solids in granular or particulate form, typically having a size range below about 4 inches, preferably most below about 1 inch, largest particle diameter and resulting from crushing of coal with a jaw crusher and the like is introduced into the hopper 24. The coal can be anthracite, bituminous, sub-bituminous or liqnite which typically has from 25 to 45 weight percent volatile matter content and a varied content of sulfur, from 0.5 to about 5 weight percent.

The apparatus can also be used to carbonize oil shale and to hydrogenate the volatile fractions recovered from the oil shale. Typically, oil shale has from 5 to about 80 gallons of recoverable hydrocarbons per ton. These hydrocarbons are adsorbed or occluded in a rock structure and it is necessary to crush the oil shale, as mined, to a suitable size for processing, such as indicated above for coal. The crushed oil shale can then be heated to a sufficient distillation and pyrolysis temperature, e.g., from 900 degrees to 1800 degrees F., in the apparatus to recover and hydrogenate its hydrocarbon values.

The solids flow downwardly as a dense compact bed through the feed conduits 22 from where the coal is discharged onto the upper surface of the compact dense bed 99 of solids within the kiln. This bed of solids is formed as an annular, downwardly flowing, dense bed of solids which surrounds the gas burner tube 32. Combustion of a fuel in burner 30 discharges a flue gas into the burner tube 32 which is heated to a high temperature by flame radiation and contact with the hot flue gases. The hot flue gases are discharged into a turbulent admixture with recycle gases, chiefly steam and hydrogen introduced through the gas inlet conduit 74. Generally, the combustion of a fuel such as natural gas is performed to release from 300,000 to about 800,000 BTUs per ton of coal treated. The recycle gases are mixed with the hot flue gases to reduce their temperature from 2700 degrees F. to about 1800 degrees F. The turbulence of the gases is augmented by the tangential discharge of gases through the vanes 70 and the resultant mixture of hot gases passes downwardly through the gas distributor 34 from where it is discharged into contact with the coal solids in the annular dense bed 99. Some of the gases are aspirated into the aspirator nozzle 72 as shown by the arrowhead lines 123 where the gas is mixed with the recycled hydrogen and steam introduced through nozzle 74. The remainder of the hot gases discharge into bed 99 and flow upwardly therethrough, countercurrent to the downwardly flowing solids.

The coal solids introduced into the upper portion of bed 99 are discharged at a temperature from ambient to about 200 degrees F. As the coal solids move downwardly through annular bed 99, they are heated in the upper portion of the bed to a temperature of about 900 degrees upon reaching level 130 shown by the phantom line. The region of the bed above line 130 is known as the condensing zone of the process and can be from 6 to about 18 feet in depth, or from 20 to 40 percent of the total depth of the dense bed of solids. In this zone, the higher boiling fractions which constitute approximately 5 to 20 percent, preferably about 5 to 10 percent of the total volatiles evolved from the process, condense on the cooler coal solids and are recycled or refluxed to the process. The lighter or lower boiling fractions which are not condensed on the coal solids and which constitute from 80 to 95 percent of the total volatiles are further condensed into a mist and are removed through conduit 76, quenched by the water spray from nozzle 102 and the resultant mixture of entrained water and oil droplets is discharged into rotocone 104. The tangential velocity imparted to the droplets by rotocone 104 separates the droplets from the vapors which are removed through line 108 for recycling to the process. The hydrogenated coal tar and distillates are removed as a liquid stream through line 110 and passed into a conventional water/oil separator from which the liquid products are removed through line 124.

The coal solids pass form the condensing zone into the hydrogenation zone of the bed which can be from 3 to about 19 feet in depth, or from 10 to about 30 percent of the total depth of the dense bed of solids. In this zone the mixture of steam and hydrogen which flows countercurrent to the solids flow heats the coal from the inlet temperature of around 900 degrees F. to a temperature between about 1200 and 1800 degrees F. Preferably the coal reaches a temperature about 1600 degrees F. As the coal is heated during its transit through this hydrogenation zone, some or all portions of the volatile matter of the coal are released in vapor form and are immediately hydrogenated by contact with hot hydrogen in this hydrogenation zone. The coal tar which is evolved as an aromatic pitch like tar is thus converted into a waxy-like product.

Steam is supplied to the process at a rate from 100 to 500 pounds per ton of coal treated. It is desirable to maintain sufficient steam in the high temperature zones to provide from 15 to 70 percent of the total gas pressure, thereby preventing carbonization of the steel equipment. The steam also serves as a reactant in the manner indicated below.

The zone between the broken lines 132 and 134 is the desulfurization zone which is from 3 to about 10 feet in depth. In this zone two principal reactions occur. These reactions are the desulfurization of sulfur contaminants in the coke product which generally proceeds by the following reaction:

$$FeS_2+FeS+3H_2O \rightarrow Fe_2O_3+3H_2S.$$

The second reaction which occurs in the desulfurization zone is a reaction between steam and coke to produce hydrogen and carbon monoxide, as follows:

$$C+H_2O \rightarrow CO+H_2.$$

The resulting hydrogen supplies a source of hydrogen for use in the hydrogenation zone which is encountered as the gases flow upwardly, countercurrent to the downward flow of coal solids. The coal is heated in the desulfurization zone by the hot flue gases and steam to a temperature from 1200 degrees to 1800 degrees F., preferably to a temperature of about 1600 degrees F., at which temperature both of the aforementioned reactions proceed at a rapid rate. The necessary heat to maintain the reaction is provided by combustion of a fuel such as natural gas or the volatile gases evolved from the process. Either air or oxygen may be used in the combustible mixture.

The solids flow through the kiln is regulated and maintained by the oscillating movement of the solids baffle 40 under action of the hydraulic drive mechanisms 94. As the baffle is oscillated, its corrugated surface exerts a shearing action on solids contained within the solids flow bed. This ensures that the coal, which is in a plastic state during a portion of its transit through the kiln, does not agglomerate and is, instead, passed through the bed as a granular, free flowing solid. If desired, a plurality of these solids baffles 40 can be provided at spaced-apart vertical locations within the kiln, strategically located to ensure that no agglomerates are formed at any of the vertical locations within bed 99.

The solids which are discharged from the desulfurization zone are received within a cooling zone, beneath phantom line 134. During transit through this cooling zone, these solids are contacted with a countercurrent upwardly flowing stream of cool recycle gases introduced through line 116 and nozzle 78. The recycled gases, comprising chiefly hydrogen, carbon monoxide and low temperature (170 degrees to 212 degrees) steam are introduced into the lower portion of the desulfurization zone. The depth of this zone will vary somewhat with the particular application. Generally, however the zone will be from four to about ten feet in depth and a sufficient quantity of steam, carbon monoxide and hydrogen, e.g., 35,000 to 100,000, preferably, about 60,000, standard cubic feet per ton of coal treated, is introduced to cool the coke product from an inlet temperature of approximately 1600 degrees F. to an acceptable outlet temperature, less than 500 degrees and preferably less than 225 degrees F. The steam and recycle gases which are preheated by this contact are then passed directly into the coke desulfurization zone. The resultant, cooled and desulfurized coke solids are discharged through conduit 28.

The invention will now be described by reference to the following example which will set forth results typically obtained.

EXAMPLE I

The process of the invention was practiced in a vertical kiln substantially similar to that shown in FIGS. 1 and 2 having a capacity of 100 tons per day of coal. This kiln had a vertical height of 26 feet and an internal diameter of 6 feet. The kiln had a central gas burner with a burner tube having a diameter of 2 feet. Bituminous coal, type B, having a heating value of 13,030 BTUs per pound, the analysis shown in Table I was supplied to the kiln at a rate of 85 tons per day.

TABLE I

| COMPONENT | WEIGHT PERCENT |
|---|---|
| Moisture | 4.6 |
| Volatile Matter | 38.6 |
| Fixed Carbon | 50.6 |
| Ash | 6.0 |
| Sulfur | 1.0 |
| Hydrogen | 5.7 |
| Carbon | 72.9 |
| Nitrogen | 1.5 |
| Oxygen | 12.9 |

The coal was introduced at an average temperature of 50 degrees and natural gas was supplied to the gas burner at a rate sufficient to release a one million BTUs per hour to the coal within the kiln. Steam was supplied to the kiln at a rate of 500 pounds per hour. The process was conducted to provide a maximum temperature in the desulfurization zone of 1600 degrees F. At this temperature, the coke removed from the kiln had a volatile matter content of 2 to 4 weight percent with a sulfur content of from 0.2 to 0.22, evidencing a substantial desulfurization of the coke. The hydrogenated low temperature tar was recovered from the process at a rate of 120 gallons per hour and this hydrogenated tar had wax-like properties with a pour point of 50 degrees F. and a gravity of 18 degrees API. The resultant coal tar can be readily marketed as a fuel oil or blended with petroleum crude charged to a refinery.

The invention has been described with reference to the illustrated and presently preferred embodiment. It is not intended that the invention be unduly limited by this disclosure of the presently preferred embodiment. Instead, it is intended that the invention be defined by the method steps, and their obvious equivalents, set forth in the following claims.

What is claimed is:

1. A process for production of hydrogenated coal tar, distillate products and a low sulfur content coke from a coal containing sulfur impurities, including iron sulfides, which comprises:

(a) introducing particulate coal solids into the top of a dense bed and passing said coal downwardly through said dense bed by withdrawing coke solids from the bottom of said bed and withdrawing evolved volatile coal tar fractions and gases from the top of said bed and maintaining conditions within said bed to provide the following successive treatment zones:

(i) a condensing zone having a depth from 20 to 40 percent of the depth of said bed where the coke is heated to a temperature of about 900 degrees F. and the higher boiling coal tar fractions are condensed and refluxed to subjacent zones;

(ii) a hydrogenation zone having a depth from 10 to about 30 percent of the depth of said bed where the coke and refluxed higher boiling tars are heated to a temperature of about 1200 degrees F. in the presence of hydrogen evolved in the subjacent desulfurization zone;

(iii) a desulfurization zone having a depth from 3 to about 10 feet where the coke product from the preceding zone is heated to a temperature of about 1800 degrees F. and reacts with steam, producing hydrogen, and the sulfur impurities including iron sulfides are desulfurized by reaction with steam; and (iv) a cooling zone having a depth from 4 to about 10 feet where the coke product is cooled to a temperature below about 500 degrees F.;

(b) generating a hot flue gas by burning a fuel in a burner centrally positioned within said bed;

(c) mixing the hot flue gas with steam, carbon monoxide and hydrogen and discharging the mixture into the lower portion of said desulfurization zone for direct contact with said coal and coke solids and to effect desulfurization of said coal by;

(d) introducing a recycle gas stream containing hydrogen, carbon monoxide and steam into the lower portion of said cooling zone for countercurrent flow, contact with coke solids therein;

(e) withdrawing a vapor stream from the upper portion of said condensing zone to induce said countercurrent flow of gases through said successive treatment zones;

(f) condensing and separating liquid coal tar and distillate fractions from said vapor stream and returning a portion of said vapor stream as said recycle gas stream;

(g) maintaining the temperatures of coal and coke solids in the aforesaid zones by combustion of a fuel in said burner and by controlling the flow of solids through said zones to effect pyrolysis of said coal to coal tar and coke and to effect desulfurization of said coke and hydrogenation of said coal tar.

2. The process of claim 1 wherein said hot flue gas is generated and passed through within a central zone extending through said condensing and hydrogenation zones.

3. The process of claim 1 wherein said coal solids are forced laterally in an oscillatory manner during their transit through said bed to prevent their agglomeration.

4. The process of claim 1 wherein said condensing zone has a depth from 6 to about 18 feet.

5. The process of claim 1 wherein said hydrogenation zone has a depth from 3 to about 19 feet.

6. The process of claim 1 wherein said steam is supplied to said process at a rate from 100 to about 500 pounds per ton of coal treated.

7. The process of claim 1 wherein said steam is supplied to said process at a rate sufficient to maintain its partial pressure within said bed from 15 to 70 percent of the total gas pressure, and sufficient to prevent carbonization of steel equipment used in said process.

* * * * *